US010147515B2

(12) United States Patent
Chin

(10) Patent No.: US 10,147,515 B2
(45) Date of Patent: Dec. 4, 2018

(54) FLEX FLAT CABLE STRUCTURE AND ELECTRICAL CONNECTOR FIX STRUCTURE THEREOF

(71) Applicant: ENERGY FULL ELECTRONICS CO., LTD, New Taipei (TW)

(72) Inventor: Hsu-Shen Chin, New Taipei (TW)

(73) Assignee: ENERGY FULL ELECTRONICS CO., LTD., New Taipei (TW)

( * ) Notice: Subject to any disclaimer, the term of this patent is extended or adjusted under 35 U.S.C. 154(b) by 91 days.

(21) Appl. No.: 15/352,600

(22) Filed: Nov. 16, 2016

(65) Prior Publication Data

US 2018/0068761 A1 Mar. 8, 2018

(30) Foreign Application Priority Data

Sep. 6, 2016 (TW) ..... 105128809 A

(51) Int. Cl.

| | |
|---|---|
| ***H01B 7/08*** | (2006.01) |
| ***H01B 3/30*** | (2006.01) |
| ***H01B 7/02*** | (2006.01) |
| ***H01B 7/04*** | (2006.01) |
| ***H01B 9/00*** | (2006.01) |
| ***H01P 3/02*** | (2006.01) |
| ***H01R 12/77*** | (2011.01) |

(Continued)

(52) U.S. Cl.

CPC ..... *H01B 7/0823* (2013.01); *H01B 3/308* (2013.01); *H01B 7/0216* (2013.01); *H01B 7/0225* (2013.01); *H01B 7/04* (2013.01); *H01B 7/0861* (2013.01); *H01B 9/003* (2013.01); *H01B 11/203* (2013.01); *H01P 3/02* (2013.01); *H01P 5/085* (2013.01); *H01R 12/598* (2013.01); *H01R 12/62* (2013.01); *H01R 12/777* (2013.01)

(58) Field of Classification Search

CPC .... H01B 7/0823; H01B 12/777; H01B 3/308; H01B 7/04; H01B 7/0216; H01B 7/0225; H01B 9/003; H01B 7/0861

USPC ..... 174/36, 113 R

See application file for complete search history.

(56) References Cited

U.S. PATENT DOCUMENTS

| | | | | |
|---|---|---|---|---|
| 6,444,902 | B1 * | 9/2002 | Tsao | H01B 7/0861 174/113 R |
| 6,740,808 | B1 * | 5/2004 | Chang | H01B 7/0861 174/113 R |

(Continued)

FOREIGN PATENT DOCUMENTS

| | | |
|---|---|---|
| CN | 203366812 U | 12/2013 |
| CN | 102468544 B | 2/2015 |

*Primary Examiner* — Sherman Ng

(74) *Attorney, Agent, or Firm* — Soroker Agmon Nordman

(57) ABSTRACT

A FFC structure includes transmission line units and a second insulating jacket. The adjacent transmission line units are spaced. Each of the plurality of transmission line units includes one or more signal lines, a first shield layer, a first ground conductor, and a second shield layer. Each of the signal lines includes a signal conductor to transmit a data signal or a power, and a first insulating jacket enclosing the signal conductor. The first shield layer surrounds the signal line and is connected to the first insulating jacket of each of the signal lines. The first ground conductor transmits a ground voltage. The second shield layer surrounds and is connected to the first ground conductor and the first shield layer. The second insulating jacket encloses the second shield layer of the plurality of transmission line units.

8 Claims, 4 Drawing Sheets

(51) Int. Cl.

| | |
|---|---|
| ***H01R 12/59*** | (2011.01) |
| ***H01R 12/62*** | (2011.01) |
| ***H01P 5/08*** | (2006.01) |
| ***H01B 11/20*** | (2006.01) |

(56) References Cited

U.S. PATENT DOCUMENTS

| | | | | |
|---|---|---|---|---|
| 6,803,518 | B2 * | 10/2004 | Chang | H01B 11/002 174/113 R |
| 2012/0012233 | A1 | 1/2012 | Bryan | |
| 2013/0333943 | A1 | 12/2013 | Tanaka et al. | |
| 2014/0332268 | A1 * | 11/2014 | Wu | H01B 7/0225 174/74 R |
| 2016/0352047 | A1 * | 12/2016 | Xing | H01R 13/64 |

* cited by examiner

FLEX FLAT CABLE STRUCTURE AND ELECTRICAL CONNECTOR FIX STRUCTURE THEREOF

1. FIELD OF THE DISCLOSURE

The present disclosure relates to a flex flat cable (FFC) structure, and more particularly, to an FFC structure designed to reduce electromagnetic interference (EMI).

2. DESCRIPTION OF THE RELATED ART

A flex flat cable (FFC) is a new type of data cable. The FFC is produced after an insulation material and an extremely thin tin-coated flat copper line are compressed using an automatic device. The merits of the FFC is neat arrangement, a large amount of transmission volume, flat structure, compactness, easy to dismantle, flexibility so the FFC, as a data transmission cable, can be applied to all kinds of electronic products easily and flexibly. Especially, the FFC can be used in the high-frequency bending condition such as the connection of mobile components. As for the way of connection, insertion with a connector and direct welding on a printed circuit board (PCB) are both possible.

The tendency to design an electronic product is body's compactness. So the size of the cable for the electronic products is downsized accordingly. Another tendency is to transmit the data at high speed. So the transmission quality of the transmission line is toward more and more high speed. To improve the quality of the transmission line, the disturbance among signal lines and the electromagnetic interference (EMI) occurring when signals are transmitted need to be solved. There is no metal as a shield among signal lines in the conventional flat cable. When signals are transmitted at high speed, disturbance occurs between any neighboring signal lines. As a result, the transmission quality of the signal line where signals are transmitted is negatively affected. Conventionally, a metal foil encloses the outer side of the signal line in the flat cable to reduce disturbance occurring between any neighboring signal lines while signals are transmitted at high speed. Besides, only one single metal foil encloses each of the signal lines as a metal shield, and the metal foil is connected to a single ground conductor in the conventional flat cable. However, a metal foil and a single ground conductor may become unstable easily due to bending of a conventional flat cable.

SUMMARY

In light of this, it is necessary to propose a flex flat cable (FFC) structure and an FFC electrical connector fix structure to solve the technical problem that a metal foil and a single ground conductor may become unstable easily due to bending of a flat cable in the related art.

According to the present disclosure, a flex flat cable (FFC) structure includes a plurality of transmission line units and a second insulating jacket. The transmission line units are arranged in parallel. The adjacent transmission line units are spaced. Each of the plurality of transmission line units includes one or more signal lines, a first shield layer, a first ground conductor, and a second shield layer. Each of the signal lines includes a signal conductor to transmit a data signal or a power, and a first insulating jacket enclosing the signal conductor. The first shield layer surrounds the signal line and k the first insulating jacket of each of the signal lines. The first ground conductor which is arranged on one side of the signal line and connected to the first shield layer, transmits a ground voltage. The second shield layer surrounds and is connected to the first ground conductor and the first shield layer. The second insulating jacket encloses the second shield layer of the plurality of transmission line units.

Optionally, the first insulating jackets of the two or more neighboring signal lines are connected with each other in some of the plurality of transmission line units.

Optionally, a gap stays between the two or more signal lines and the first shield layer in some of the plurality of transmission line units.

Optionally, some of the plurality of transmission line units further comprise a second ground conductor; the first ground conductor and the second ground conductor are arranged on both sides of the two signal lines respectively and are connected to the first shield layer to transmit the ground voltage.

Optionally, a gap stays among the second ground conductor, the first shield layer, and the second shield layer of the each of the plurality of transmission line units.

Optionally, a gap stays among the first ground conductor, the first shield layer, and the second shield layer of the each of the plurality of transmission line units.

Optionally, the first shield includes a first conductive layer connected to the second shield layer, and an isolation layer enclosing the first insulating jacket.

Optionally, the second shield includes a second conductive layer connected to the first ground conductor and the first conductive layer, and a third conductive layer, connected to the second insulating jacket.

Optionally, materials of the first insulating jacket and second insulating jacket are selected from a group consisting of polyethylene (PE), polyvinyl chloride (PVC), Thermoplastic Elastomer (TPE), Thermoplastic Polyurethane (TPU), thermoplastic rubber (TPR), Thermoplastic Polyolefin (TPO), Polyurethane (PUR), Polypropylene (PP), Polyolefins (PO), PolyVinyliDene Fluoride (PVDF), Ethylene-chlorotrifluororthylene copolymer (ECTFE), ethylene-tetra-fluoro-ethylene (ETFE), Teflon Fluorinated ethylene propylene (Teflon FEP), Polytetrafluoroethene (PTFE), Teflon, or nylon.

According to the present disclosure, a flex flat cable (FFC) electrical connector fix structure includes an electrical connector and a flex flat cable (FFC) structure includes a housing, a spacer assembled onto the housing and having a plurality of containing recesses, a printed circuit board (PCB) with a plurality of conductive portions and a plurality of connecting portions, a plurality of terminals, and a shell assembled onto the housing. The plurality of conductive portions are electrically connected to the plurality of corresponding connecting portions respectively. One end of the plurality of terminals passes through the containing recess and is connected to the plurality of connecting portions. The FFC structure includes a plurality of transmission line units and a second insulating jacket. The transmission line units are arranged in parallel. The adjacent transmission line units are spaced. Each of the plurality of transmission line units includes one or more signal lines, a first shield layer, a first ground conductor, and a second shield layer. Each of the signal lines includes a signal conductor to transmit a data signal or a power, and a first insulating jacket enclosing the signal conductor. The first shield layer surrounds the signal line and is connected to the first insulating jacket of each of the signal lines. The first ground conductor which is arranged on one side of the signal line and connected to the first shield layer, transmits a ground voltage. The second shield layer surrounds and is connected to the first ground conductor and the first shield layer. The second insulating jacket encloses the second shield layer of the plurality of transmission line units. The signal conductor and first ground conductor are connected to the plurality of conductive portions.

Compared with the conventional technology, the present disclosure features that all of the signal lines are divided into a plurality of transmission line units in the FFC structure and the FFC electrical connector fix structure, and each of the plurality of transmission line units includes a first shield layer, a second shield layer, and a ground conductor. The first shield layer and the second shield layer have the ability of reflecting and absorbing electromagnetic waves. The ground conductor is arranged between the first shield layer and the second shield layer so that the first shield layer and the second shield layer can be connected to the ground conductor. The FFC shield ground structure becomes more stable since the ground conductor is connected to both sides of the first shield layer and both sides of the second shield layer. The signal line for each of the plurality of transmission line units encloses the first shield layer and the second shield layer so the FFC structure has a better anti-EMI ability than the conventional flat cable does. Therefore, the EMI produced when the signal is transmitted through the conventional flat cable is effectively solved with the FFC structure proposed by the present disclosure.

These and other objectives of the claimed invention will no doubt become obvious to those of ordinary skill in the art after reading the following detailed description of the preferred embodiment that is illustrated in the various figures and drawings.

DETAILED DESCRIPTION OF THE PREFERRED EMBODIMENTS

For better understanding embodiments of the present disclosure, the following detailed description taken in conjunction with the accompanying drawings is provided. Apparently, the accompanying drawings are merely for some of the embodiments of the present disclosure. Any ordinarily skilled person in the technical field of the present disclosure could still obtain other accompanying drawings without use laborious invention based on the present accompanying drawings.

The following descriptions of all embodiments, with reference to the accompanying drawings, are used to exemplify the present disclosure. Directional terms mentioned in the present disclosure, such as "top", "bottom", "front", "back", "left", "right", "inside", "outside", "side", etc., are only used with reference to the orientation of the accompanying drawings. Therefore, the used directional terms are intended to illustrate, but not to limit, the present disclosure.

Figure 1:
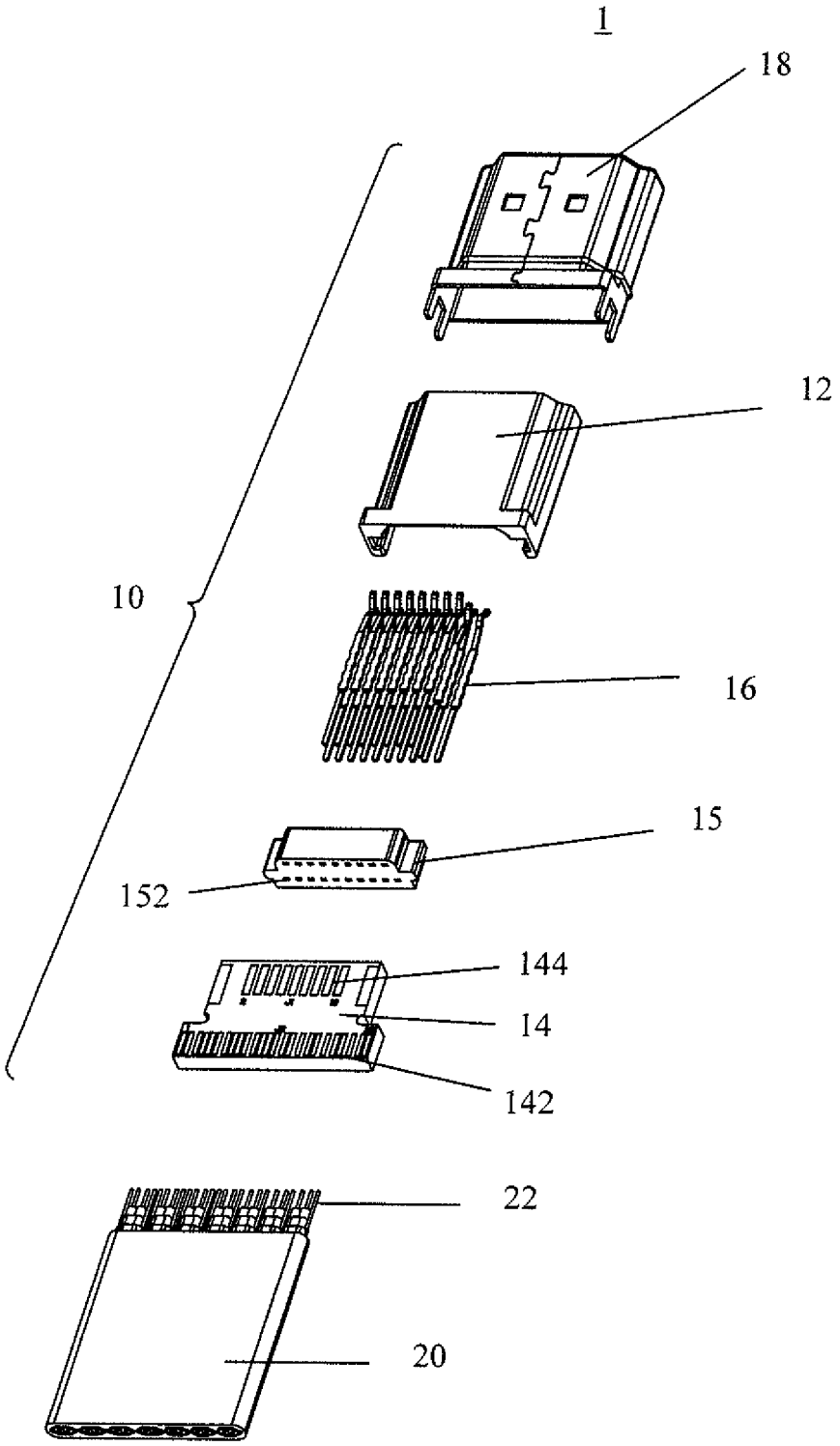
FIG. 1 is a breakdown diagram illustrating a flex flat cable structure (FFC) electrical connector fix structure according to one preferred embodiment of the present disclosure.
Figure 2:
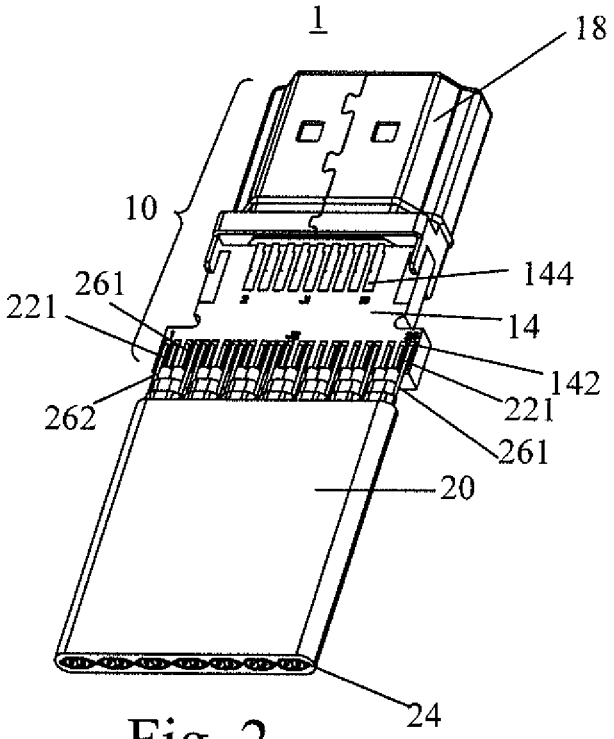
FIG. 2 and FIG. 3 are assembly drawings illustrating the FFC electrical connector fix structure from different view angles.
Figure 3:
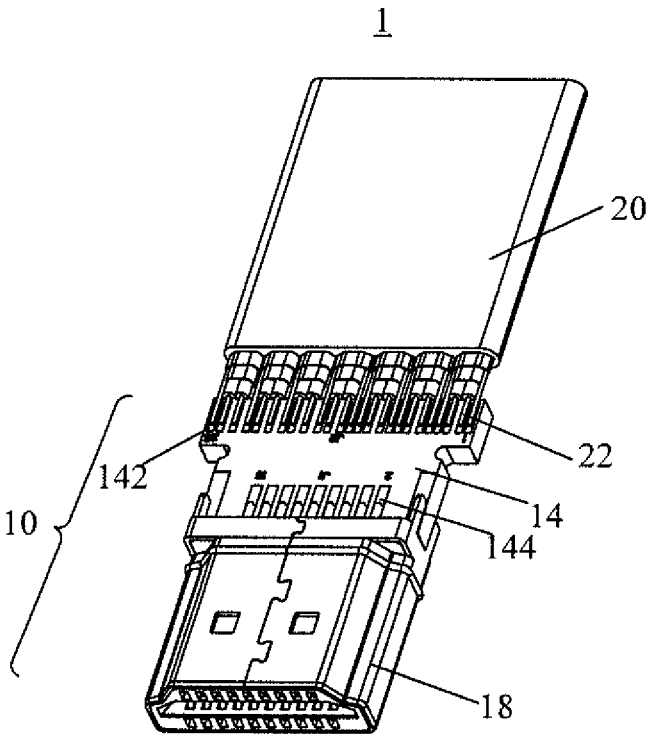
Figure 4:
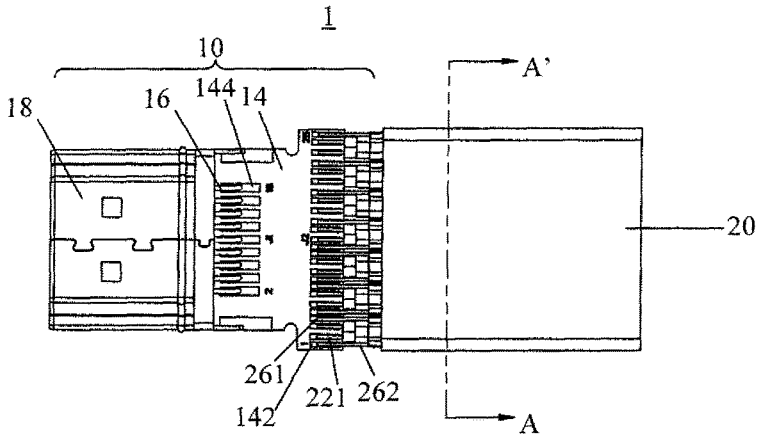
FIG. 4 is a top view illustrating the FFC electrical connector fix structure shown in FIG. 1.

Refer to FIG. 1 to FIG. 4. FIG. 1 is a breakdown diagram illustrating a flex flat cable structure (FFC) electrical connector fix structure 1 according to one preferred embodiment of the present disclosure. FIG. 2 and FIG. 3 are assembly drawings illustrating the FFC electrical connector fix structure 1 from different view angles. FIG. 4 is a top view illustrating the FFC electrical connector fix structure 1 shown in FIG. 1. The FFC electrical connector fix structure 1 includes an electrical connector 10 and an FFC structure 20. The FFC structure 20 is inserted into the electrical connector 10. The electrical connector 10 can be any connector as long as the data rate of the connector, such as high definition multimedia interface (HDMI)/universal serial bus (USB) 3.0/USB3.1/Display Port/serial advanced technology attachment (SATA) is higher than 1 Gb/s.

The electricity connector 10 includes a housing 12, a circuit board 14, a spacer 15, a plurality of terminals 16, and a shell 18. The spacer 15 is assembled to the housing 12. The spacer 15 includes a plurality of grooves 152. The circuit board 14 includes a plurality of conductive portions 142 and a plurality of connective portions 144. The plurality of conductive portions 142 are electrically connected to the plurality of connective portions correspondingly. One terminal of each of the plurality of terminals 16 penetrates each of the plurality of grooves 152 correspondingly and is connected to the plurality of connective portions 144. The shell 18 is assembled to the housing 12.

Figure 5:
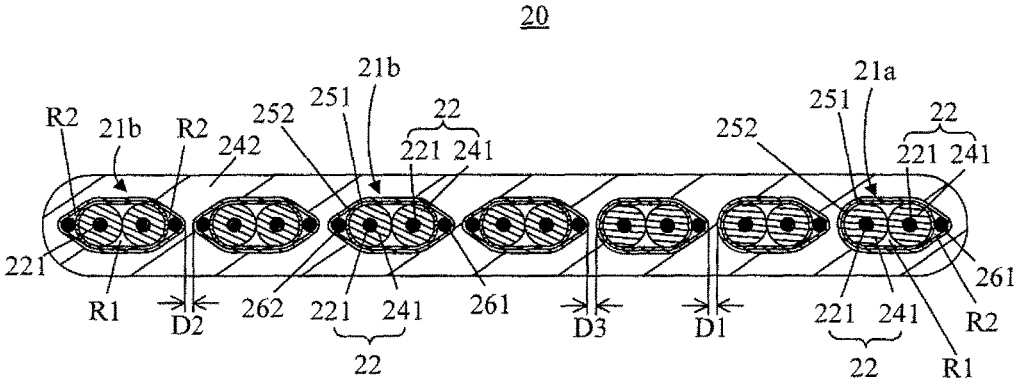
FIG. 5 is a sectional view illustrating the FFC structure along an A-A' line shown in FIG. 4.

Please refer to FIG. 5. FIG. 5 is a sectional view illustrating the FFC structure 20 along an A-A' line shown in FIG. 4. The FFC structure 20 includes a plurality of transmission line units 21*a* and 21*b* and a second insulating jacket 242. The plurality of transmission line units 21*a* and 21*b* are arranged in parallel. A gap D1 stays between any two of the neighboring transmission line units 21*a*. A gap D2 stays between any two of the neighboring transmission line units 21*b*. A gap D3 stays between any two of the neighboring transmission line units 21*a* and 21*b*. Depending on demands, all of the gaps D1-D3 are equal, any two of the gaps D1-D3 are equal, or none of the gaps D1-D3 are equal. The transmission line unit 21*a* may include one or two signal lines 22, a first shield layer 251, a first ground conductor 261, and a second shield layer 252. The transmission line unit 21*b* includes two signal lines 22, a first shield layer 251, a first ground conductor 261, a second ground conductor 262, and a second shield layer 252. In another embodiment of the present disclosure, the transmission line units 21*a* and 21*b* may include three or more signal lines 22. Each of the signal lines 22 includes a signal conductor 221 and a first insulating jacket 241. The plurality of signal conductors 221 of the plurality of transmission line units 21*a* and 21*b* are arranged in parallel. The plurality of signal conductors 221 can be used to transmit power or a data signal if needed. The signal conductor 221 can be stranded conductors or a solid round conductor. The first insulating jacket 241 encloses the signal conductor 221. The first shield layer 251 encloses the signal line 22 and is connected to the first insulating jacket 241 of each of the plurality of signal lines 22. In the transmission line unit 21*a*, the first ground conductor 261 is arranged on one side of the signal line 22 and is connected to the first shield layer 251 to transmit a ground voltage. In the transmission line unit 21*b*, the first ground conductor 261 and the second ground conductor 262 are arranged on both sides of the two signal lines 22 and are connected to the first shield layer 251 to transmit the ground voltage. The second shield layer 252 surrounds and is connected to the first ground conductor 261 and the first shield layer 251. The second insulating jacket 242 encloses the second shield layer 252 of the plurality of transmission line units 21*a* and 21*b*.

In some of the plurality of transmission line units 21*a* and 21*b*, the first insulating jackets 241 of the neighboring signal lines 22 are connected to each other. Moreover, a buffer R1 is spared between the signal line 22 of some of the plurality of transmission line units 21*a* and 21*b* and the first shield layer 251. When the FFC structure 20 is bent or squeezed, the buffer R1 enhances the flexibility of the cables effectively.

In each of the plurality of transmission line units 21*a* and 21*b*, a buffer R2 is spared among the first ground conductor 261, the first shield layer 251, and the second shield layer 252. The buffer R2 is also spared among the second ground conductor 262, the first shield layer 251, and the second shield layer 252. Once the FFC structure 20 is bent or squeezed, the buffer R2 enhances the flexibility of the cables effectively.

In this embodiment, some of the plurality of transmission line units 21 includes two signal lines 22 and a first ground conductor 261. The first ground conductor 261 is enclosed by the second insulating jacket 242. The metal shield layer 26 is used to isolate the first insulating jacket 241 from the second insulating jacket 242 and forms a metal shield for a plurality of signal lines 22. The metal shield layer 26 may be either a metal grid or a metal thin film. Besides, some of the plurality of transmission line units 21 can include more than three signal lines 22 and one ground line 261. Each of the plurality of transmission line units 21 includes the signal conductor 221 enclosed by the first insulating jacket 241 and the first insulating jacket 241 surrounded by the metal shield layer 26.

The plurality of signal conductors 221 in the FFC structure 20 protrude from the second insulating jacket 242 and the first insulating jacket 241. The first ground conductor 261 and the second ground conductor 262 protrude from the second insulating jacket 242. When the FFC structure 20 is inserted into the electrical connector 10, the protruded signal conductor 221, the protruded first ground line 261, and the protruded second ground line 262 can be electrically connected to the conductive portion 142 which the circuit board 14 corresponds to.

Figure 6:
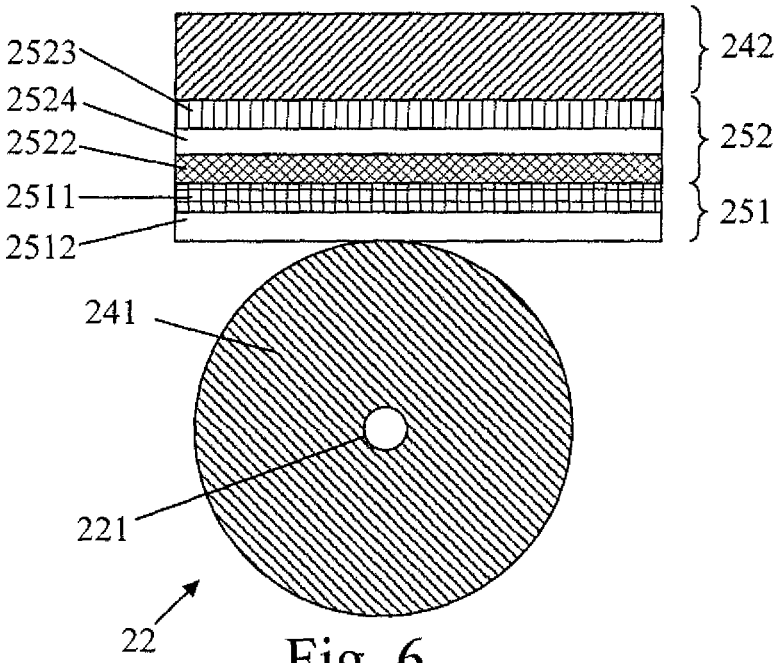
FIG. 6 is a schematic diagram of a first shield layer, a second shield layer, and a signal line.

Please refer to FIG. 6. FIG. 6 is a schematic diagram of a first shield layer 251, a second shield layer 252, and a signal line 22. The first shield layer 251 includes a first conductive layer 2511 and an isolation layer 2512. The second shield layer 252 includes a second conductive layer 2522 and a third conductive layer 2523. Preferably, the second shield layer 252 further includes a bonding layer 2524. If the second conductive layer 2522 and the third conductive layer 2523 are produced by materials with different conductive characteristics, the bonding layer 2524 can be used to separate the second conductive layer 2522 from the third conductive layer 2523. It is also convenient that the second conductive layer 2522 and the third conductive layer 2523 are arranged on one and the other sides of the bonding layer 2524, respectively. The third conductive layer 2523 is connected to the second insulating jacket 242. The first conductive layer 2511 is connected to the second shield layer 252. The isolation layer 2512 encloses the first insulating jacket 241. The isolation layer 2512 is produce by a nonconductive material to isolate the signal line 22 from the first conductive layer 2511. The second conductive layer 2522 is connected to the first ground conductor 261 and the first conductive layer 2511. The third conductive layer 2523 is connected to the second insulating jacket 242. The first conductive layer 2511, the second conductive layer 2522, and the third conductive layer 2523 may be thin films or grids produced by conductive metal, such as aluminum, copper, and silver, to reflect and absorb electromagnetic waves.

The first ground conductor 261 and the second ground line 262 are connected to the first conductive layer 2511 of the first shield layer 251 and the second conductive layer 2522 of the second shield layer 252 at the same time to stabilize the first ground conductor 261 and the second ground line 262. In addition, the first conductive layer 2511 of the first shield layer 251 forms a metal shield for the surrounded signal line 22 to prevent the signal transmitted through the signal line 22 from being disturbed. Also, the second shield layer 252 forms a metal shield for the surrounded signal line 22 so that the signal line 22 can fight against disturbance better.

Material of the first insulating jacket 241 is different from that of the second insulating jacket 242. Preferably, the first insulating jacket 241 and the second insulating jacket 242 may be insulating materials with highly thermal resistance such as polyethylene (PE), polyvinyl chloride (PVC), Thermoplastic Elastomer (TPE), Thermoplastic Polyurethane (TPU), thermoplastic rubber (TPR), Thermoplastic Polyolefin (TPO), Polyurethane (PUR), Polypropylene (PP), Polyolefins (PO), PolyVinyliDene Fluoride (PVDF), Ethylene-chlorotrifluororthylene copolymer (ECTFE), ethylene-tetra-fluoro-ethylene (ETFE), Teflon Fluorinated ethylene propylene (Teflon PEP), Polytetrafluoroethene (PTFE), Teflon, and nylon. The signal conductor 221, first ground conductor 261, and second ground line 262 may be a highly thin, flat tinned copper wire.

The present disclosure features that all of the signal lines are divided into a plurality of transmission line units in the FFC structure and the FFC electrical connector fix structure, and each of the plurality of transmission line units includes a first shield layer, a second shield layer, and a ground conductor. The first shield layer and the second shield layer have the ability of reflecting and absorbing electromagnetic waves. The ground conductor is arranged between the first shield layer and the second shield layer so that the first shield layer and the second shield layer can be connected to the ground conductor. The FFC shield ground structure becomes more stable since the ground conductor is connected to both sides of the first shield layer and both sides of the second shield layer. The signal line for each of the plurality of transmission line units encloses the first shield layer and the second shield layer so the FFC structure has a better anti-EMI ability than the conventional flat cable does. Therefore, the EMI produced when the signal is transmitted through the conventional flat cable is effectively solved with the FFC structure proposed by the present disclosure.

Although the present disclosure has been disclosed as preferred embodiments, the foregoing preferred embodiments are not intended to limit the present disclosure. Those of ordinary skill in the art, without departing from the spirit and scope of the present disclosure, can make various kinds of modifications and variations to the present disclosure. Therefore, the scope of the claims of the present disclosure must be defined.

What is claimed is:

1. A flex flat cable (FFC) structure, comprising: a plurality of transmission line units arranged in parallel, adjacent transmission line units being spaced, each of the plurality of transmission line units comprising: one or more signal lines, each of the signal lines comprising: a signal conductor, to transmit a data signal or a power; and a first insulating jacket, enclosing the signal conductor; a first shield layer, surrounding the signal line and being connected to the first insulating jacket of each of the signal lines; a first ground conductor, arranged on one side of the signal line and connected to the first shield layer, and to transmit a ground voltage; and a second shield layer, surrounding and being connected to the first ground conductor and the first shield layer; and a second insulating jacket, enclosing the second shield layer of the plurality of transmission line units, wherein the first shield layer comprises: a first conductive layer, connected to the second shield layer; and an isolation layer, enclosing the first insulating jacket; wherein the second shield layer comprises: a second conductive layer, connected to the first ground conductor and directly contacting the first conductive layer; and a third conductive layer, connected to the second insulating jacket.

2. The FFC structure of claim 1, wherein the first insulating jackets of the two or more neighboring signal lines are connected with each other in some of the plurality of transmission line units.

3. The FFC structure of claim 1, wherein a gap stays between the two or more signal lines and the first shield layer in some of the plurality of transmission line units.

4. The FFC structure of claim 1, wherein some of the plurality of transmission line units further comprise a second ground conductor; the first ground conductor and the second ground conductor are arranged on both sides of the two signal lines respectively and are connected to the first shield layer to transmit the ground voltage.

5. The FFC structure of claim 4, wherein a gap stays among the second ground conductor, the first shield layer, and the second shield layer of the each of the plurality of transmission line units.

6. The FFC structure of claim 1, wherein a gap stays among the first ground conductor, the first shield layer, and the second shield layer of the each of the plurality of transmission line units.

7. The FFC structure of claim 1, wherein materials of the first insulating jacket and second insulating jacket are selected from a group consisting of polyethylene (PE), polyvinyl chloride (PVC), Thermoplastic Elastomer (TPE), Thermoplastic Polyurethane (TPU), thermoplastic rubber (TPR), Thermoplastic Polyolefin (TPO), Polyurethane (PUR), Polypropylene (PP), Polyolefins (PO), PolyVinyliDene Fluoride (PVDF), Ethylene-chlorotrifluororthylene copolymer (ECTFE), ethylene-tetra-fluoro-ethylene (ETFE), Teflon Fluorinated ethylene propylene (Teflon FEP), Polytetrafluoroethene (PTFE), Teflon, or nylon.

8. A flex flat cable (FFC) electrical connector fix structure, comprising:

an electrical connector, comprising:

a housing;

a spacer, assembled onto the housing, and comprising a plurality of containing recesses;

a printed circuit board (PCB), comprising a plurality of conductive portions and a plurality of connecting portions, and the plurality of conductive portions being electrically connected to the plurality of corresponding connecting portions respectively;

a plurality of terminals, one end of the plurality of terminals passing through the containing recess and being connected to the plurality of connecting portions; and a shell, assembled onto the housing; and an FFC structure, comprising:

a plurality of transmission line units arranged in parallel, adjacent transmission line units being spaced, each of the plurality of transmission line units comprising:

one or more signal lines, each of the signal lines comprising:

a signal conductor, to transmit a data signal or a power; and a first insulating jacket, enclosing the signal conductor;

a first shield layer, surrounding the signal line and being connected to the first insulating jacket of each of the signal lines;

a first ground conductor, arranged on one side of the signal line and connected to the first shield layer, and to transmit a ground voltage; and a second shield layer, surrounding and being connected to the first ground conductor and the first shield layer; and a second insulating jacket, enclosing the second shield layer of the plurality of transmission line units, wherein the signal conductor and first ground conductor are connected to the plurality of conductive portions.

* * * * *